US010161066B2

(12) United States Patent
Yeung

(10) Patent No.: US 10,161,066 B2
(45) Date of Patent: Dec. 25, 2018

(54) MULTI-COMPONENT ELASTIC YARN, TEXTILE FABRICS AND METHOD OF MAKING AND APPARATUS THEREOF

(71) Applicant: Dai Chung Trading (Hong Kong) Ltd., Hong Kong (HK)

(72) Inventor: Hoi Hung Eddie Yeung, Hong Kong (HK)

(73) Assignee: TVN INVESTMENT LIMITED, Tortola (BV)

( * ) Notice: Subject to any disclaimer, the term of this patent is extended or adjusted under 35 U.S.C. 154(b) by 530 days.

(21) Appl. No.: 14/415,140

(22) PCT Filed: Jul. 10, 2013

(86) PCT No.: PCT/CN2013/079139

§ 371 (c)(1),
(2) Date: Jan. 16, 2015

(87) PCT Pub. No.: WO2015/003346

PCT Pub. Date: Jan. 15, 2015

(65) Prior Publication Data

US 2015/0184319 A1 Jul. 2, 2015

(51) Int. Cl.
*D02G 3/32* (2006.01)
*D01H 1/02* (2006.01)
(Continued)

(52) U.S. Cl.
CPC ..... *D02G 3/32* (2013.01); *D01H 1/025* (2013.01); *D01H 7/52* (2013.01); *D02G 3/324* (2013.01);
(Continued)

(58) Field of Classification Search
CPC ..... D02G 3/32; D02G 3/324; D02G 3/367; D01H 7/52
See application file for complete search history.

(56) References Cited

U.S. PATENT DOCUMENTS 3,264,816 A * 8/1966 Jaggi ..... D02G 3/324 57/12
4,495,760 A * 1/1985 Vanhelle ..... D02G 3/367 57/12
(Continued)

FOREIGN PATENT DOCUMENTS

CN 101492843 7/2009
CN 101886305 A 11/2010
(Continued)

OTHER PUBLICATIONS

Second Office Action with Search Report of CN201310409947.3 issued by the State Intellectual Property Office of China dated Sep. 5, 2016.

*Primary Examiner* — Shaun R Hurley
(74) *Attorney, Agent, or Firm* — Spruson & Ferguson (Hong Kong) Limited

(57) ABSTRACT

The invention discloses a multi-component elastic yarn comprises two fiber rovings and two core filaments, wherein each core filaments is elastic, low-elastic or inelastic filaments or any combination thereof. The invention also discloses preparation method and apparatus. The multi-component elastic yarn of the present invention is featured by smooth surface, low hairiness, fiber does not falling off easily, high strength and good wearing resistance. The textile fabrics made from the present yarn have a smooth surface, low hairiness, good wearing resistance, high tensile and tear strength, soft and smooth hand feeling and high elastic recovery rate. The apparatus of the present invention has strong applicability, is easy to maintain and high cost-effective.

6 Claims, 2 Drawing Sheets

(51) Int. Cl.
*D01H 7/52* (2006.01)
*D02G 3/36* (2006.01)

(52) U.S. Cl.
CPC .... *D02G 3/367* (2013.01); *Y10T 428/249921* (2015.04); *Y10T 428/2929* (2015.01)

(56) References Cited

U.S. PATENT DOCUMENTS

| | | | | | |
|---|---|---|---|---|---|
| 4,541,231 | A * | 9/1985 | Graham, Jr. | D02G 3/185 | 57/12 |
| 4,657,205 | A * | 4/1987 | Sugioka | B65H 57/16 | 242/157 R |
| 4,903,472 | A * | 2/1990 | Vanhelle | D02G 3/367 | 57/12 |
| 6,460,322 | B1 * | 10/2002 | Sato | D02G 3/324 | 57/225 |
| 7,913,483 | B2 * | 3/2011 | Qiu | D01H 1/006 | 57/10 |
| 2008/0268734 | A1 * | 10/2008 | Tharpe | D01H 1/00 | 442/184 |
| 2010/0162677 | A1 * | 7/2010 | Qiu | D01H 1/006 | 57/12 |
| 2013/0260129 | A1 * | 10/2013 | Agzikara | D02G 3/324 | 428/221 |

FOREIGN PATENT DOCUMENTS

| | | |
|---|---|---|
| CN | 202390611 | 8/2012 |
| CN | 102733032 A | 10/2012 |
| GB | 1032896 A | 6/1966 |

* cited by examiner

MULTI-COMPONENT ELASTIC YARN, TEXTILE FABRICS AND METHOD OF MAKING AND APPARATUS THEREOF

CROSS REFERENCE TO RELATED APPLICATION

The present application is a national phase application of PCT/CN2013/079139 filed on Jul. 10, 2013, and the disclosure of which is incorporated herein by reference in its entirety.

FIELD OF THE INVENTION

The present invention relates to textile. In particular, the present invention relates to a new multi-component elastic yarn, its textile fabrics, its preparation method and apparatus for preparing.

BACKGROUND

Recent years, since there has been an increasing demand in quality elastic yarn, the quality of conventional ring-spun elastic yarn cannot meet the consumer's requirements. Moreover, as conventional ring-spun elastic yarn has relatively high hairiness and low strength, the surface smoothness and fiber strength utilization factor of yarns formed by these conventional ring-spun elastic yarn and subsequent manufacturing processes are affected. On the other hand, as weaving technology continues to advance, the performance and production capacity of shuttle and shuttleless looms continue to improve. Particularly, the problem stemmed from the high hairiness and low strength in conventional yarn becomes more prominent considering the increasingly high requirement for yarn quality by shuttleless looms. Therefore, there is a need for the development of a new multi-component elastic yarn in the market, and it has also become an important research topic in the industry.

SUMMARY OF THE INVENTION

The first objective of the present invention is to provide a multi-component elastic yarn which overcomes the deficiencies of conventional ring-spun yarn. The multi-component elastic yarn of the present invention has a smooth surface, low hairiness, high strength and good wearing resistance. The fiber of the present elastic yarn does not fall off easily. Fabrics made from the present elastic yarn have a smooth surface, low hairiness, good wearing resistance, high tensile and tear strength, soft and smooth hand feeling and high elastic recovery rate.

The second objective of the present invention is to provide a method of manufacturing the multi-component elastic yarn.

The third objective of the present invention is to provide an apparatus for manufacturing the multi-component elastic yarn.

In the first objective, the present invention provides:

A multi-component elastic yarn comprises two sets of fibrous roving and two sets of core filaments, wherein the two sets of core filaments comprises elastic, low-elastic or inelastic filaments or a combination thereof.

In one embodiment, the two sets of fibrous roving comprise a first fibrous roving and a second fibrous roving and the two sets of core filaments comprise a first core filament and a second core filament. Said first fibrous roving and said first core filament are twisted to form a first yarn and said second fibrous roving and said second core filament are twisted to form a second yarn. The first yarn and the second yarn are then twisted to form a composite yarn.

In one embodiment, weight percentage of said first and second core filaments is 4% to 50% of the total weight of the composite yarn.

In one embodiment, when one of the two sets of core filament is low-elastic or inelastic filament, the draft ratio of the low-elastic filament or inelastic core filament is 1.0-1.3; when one of the two sets of said core filament is elastic filament, the draft ratio of the elastic core filament is 1.5-4.5.

In another embodiment, when one set of the two core filaments is low-elastic or inelastic and the other set of the two core filaments is elastic filament, draft ratio of the elastic filament must be greater than the draft ratio if the low-elastic or inelastic filament.

In another embodiment, the two sets of core filament range from 20-300 denier.

In one embodiment, said fibrous roving comprises fibers, the fibers can be natural fibers, synthetic fibers, artificially dyed fibers, or any combination thereof.

In the second objective, the present invention provides:

A method for manufacturing a multi-component yarn comprises providing a ring-spinning machine comprising a back and a front roller, a first and second fibrous roving and, a first and second core filaments;

drawing the first fibrous roving and the second fibrous roving in proximity;

drafting the first and second fibrous roving by feeding the first and second roving into the back roller and then feed into the front roller;

twisting the first and second core filaments independently with the first or second fibrous roving to form a first yarn and a second yarn; and twisting the first and second yarn to form the multi-component yarn.

In the third objective, the present invention provides:

An apparatus for manufacturing a multi-component yarn, which is a ring-spinning machine, comprises two roving hangers located above for installing the first and second fibrous roving;

a two-eyes roving guide located at the back of back roller where the first and second fibrous roving pass through;

two filament drafting drums located above the back roller for installing the first and second core filaments;

two filament guides located above a front roller for the first and second core filaments to pass through.

In one embodiment, said two-eyes roving guide is an adjustable guide, wherein distance between centers of the two eyes is adjustable to 3-12 mm.

In one embodiment, said two filament drafting drums are active filament unwinders with tension control.

In one embodiment, each of said two filament guides are adjustable filament guide, wherein distance between centers of the two filament guides is adjustable to 3-15 mm.

A multi-component elastic yarn of the present invention is associated with smooth surface, low hairiness, high strength and good wearing resistance. Fiber of the elastic yarn of the present invention does not fall off easily. Textile fabric made from the present elastic yarn is associated with smooth surface, low hairiness, good wearing resistance, high tensile and tear strength, soft and smooth hand feeling, and high elastic recovery rate. The apparatus according to the present invention can be made through simple modification, has strong applicability, is easy to maintain and is highly cost-effective. The present apparatus may be modified to spin other conventional ring-spun yarn or siro-spun yarn. Thus, the present apparatus may be modified to meet the flexible and ever-changing market demand.

BRIEF DESCRIPTION OF THE DRAWINGS

Embodiments of the present invention are described in more detail hereinafter with reference to the drawings, in which.

1—multi-component yarn; 11—the first yarn; 111—the first core filament; 112—the first fibrous roving; 12—the second yarn; 121—the second core filament; 122—the second fibrous roving; 21—font roller; 22—middle roller; 23—back roller; 3—roving hanger; 4—filament drafting drum; 5—two-eyes roving guide; 6—filament guide

DETAILED DESCRIPTION OF THE INVENTION

In the following description, the present invention is set forth as preferred examples. It will be apparent to those skilled in the art that modifications, including additions and/or substitutions, may be made without departing from the scope and spirit of the invention. Specific details may be omitted so as not to obscure the invention; however, the disclosure is written to enable one skilled in the art to practice the teachings herein without undue experimentation.

Figure 1:
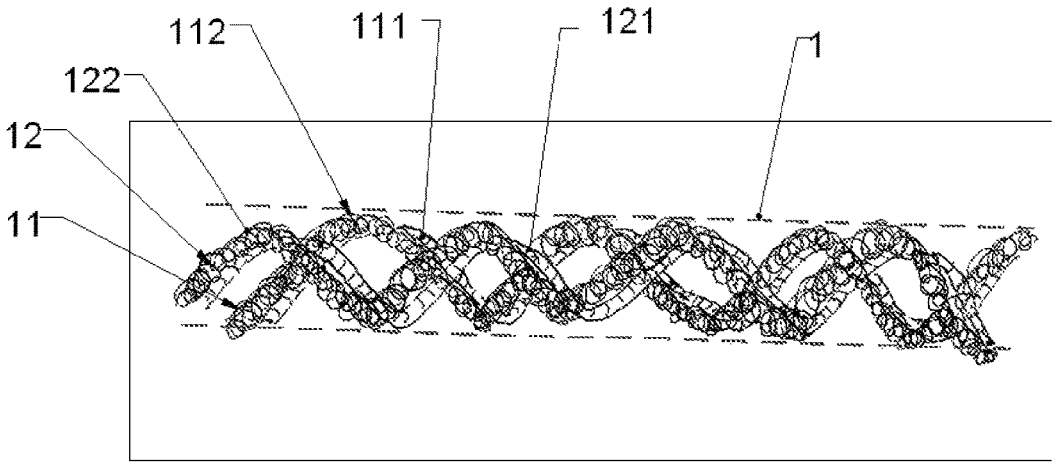
FIG. 1 is a schematic diagram of the multi-component elastic yarn of the present invention.

As seen in FIG. 1, the multi-component elastic yarn of the present invention is formed by fibrous roving and core filaments. The two sets of fibrous roving comprise the first fibrous roving 112 and the second fibrous roving 122, and said core filaments comprise the first core filament 111 and the second core filament 121. The first fibrous roving 112 and the first core filament 111 twist together to form the first yarn 11, and the second fibrous roving 122 and the second core filament 121 twist together to form the second yarn 12. The first yarn 11 and the second yarn 12 further twist together to form composite yarn 1.

Said fiber roving comprises fibers, which includes, but are not limited to, natural fibers, synthetic fibers, artificially dyed fibers, or any combination thereof. The types of fibers of the fiber roving are not critical in the present composite yarn. Any general textile fibers in the art that can be spun may be used.

The first and second core filaments are independently made of elastic, low-elastic or inelastic filaments or any combination thereof. The core filaments are preferably spandex, polyamides, polyesters, polyolefins or a combination thereof, modified polymers or copolymers. In one embodiment, the core filaments can be pre-processed to produce a compound core filament comprises elastic filaments, low-elastic filaments, inelastic filaments or any combination thereof.

The weight percentage of the core filaments to the composite yarn is not critical to the present invention. The weight percentage of the core filaments ranges 4% to 50% of the total weight of the composite yarn. The liner mass density of the core filaments is not critical to the present invention. The core filaments of the present invention ranges 20 denier to 300 denier. When the core filament is low-elastic or inelastic, the draft ratio of the low-elastic or inelastic core filament ranges 1.0 to 1.3; when the core filament is elastic, the draft ratio of the elastic core filament ranges 1.5-4.5. When one of the two core filaments are elastic filaments combine with low-elastic or inelastic filaments, the draft ratio of the elastic filaments must be greater than that of low-elastic or inelastic filaments.

The liner mass density of the composite yarn of the present invention is not critical. The liner mass density of the present composite yarn ranges Ne6 to Ne60, and preferably ranges from Ne8 to Ne30.

The liner mass density of roving in the fibrous roving is not critical to the present composite yarn. The liner mass density of the roving ranges from 0.2 g/m to 1.5 g/m and preferably ranges from 0.4 g/m to 1.0 g/m.

Figure 2:
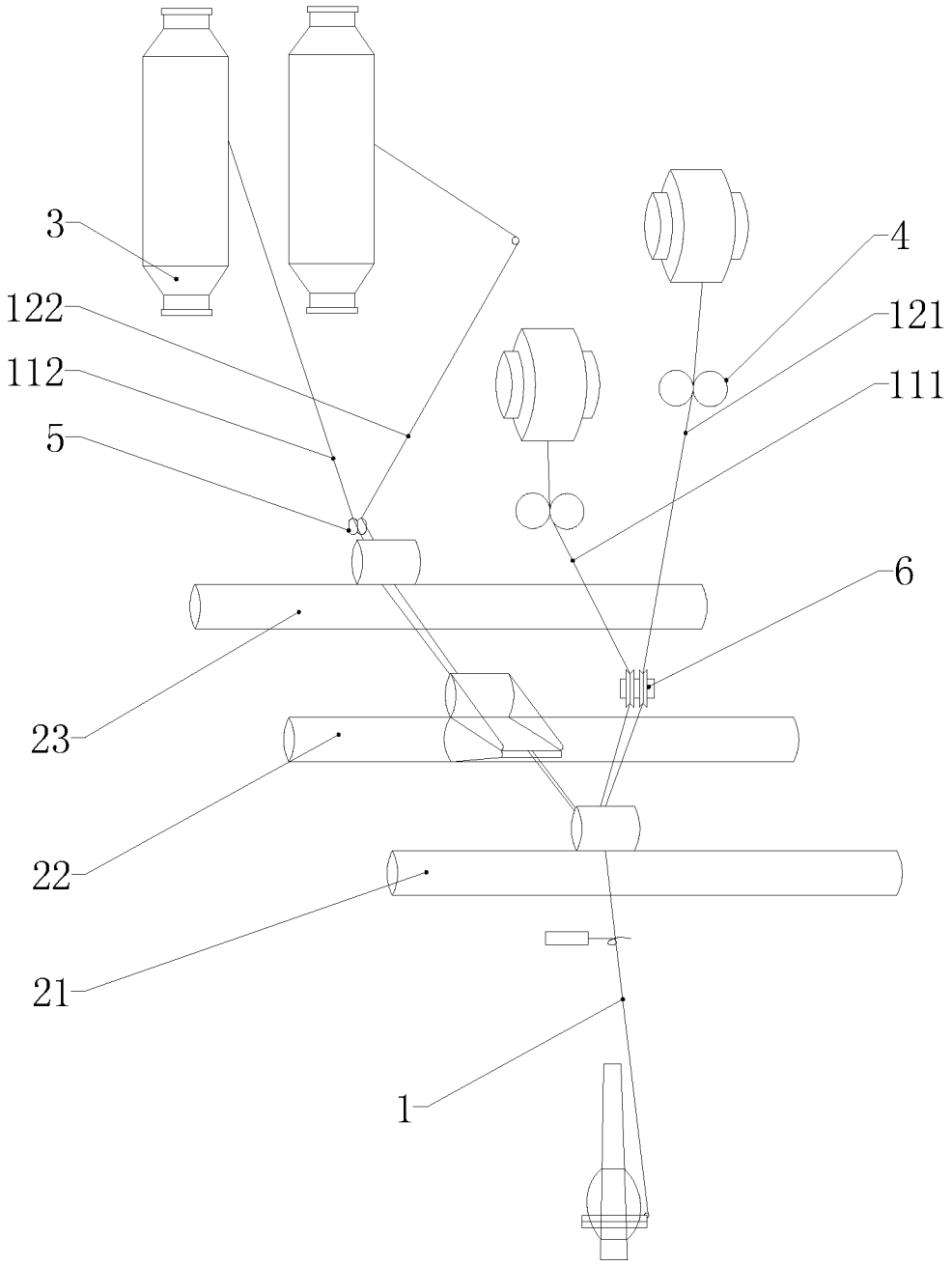
FIG. 2 is a schematic diagram of the ring-spinning apparatus of the present invention.

As shown in FIG. 2, the apparatus for manufacturing a multi-component elastic yarn according to the present invention is based on a ring spinning machine. The apparatus comprises: two roving hangers 3 located above the back roller for installing the first and second of fiber roving; a two-eyes roving guide 5 located at the back of back roller 23 for passing the first and second fiber rovings through; two filament drafting drums 4 located above the back roller for installing the first and second core filaments; and two filament guides 6 located above the front roller for passing the first and second core filaments through. In one embodiment, the two-eye roving guide is adjustable, and the distance between the centers of the two eyes can be adjustable from 3 mm to 12 mm. The filament drafting drum is an active filament unwinder with tension control. Each filament guide is adjustable, and the distance between the centers of the two filament guides ranges 3 mm to 15 mm.

The apparatus for manufacturing a multi-component yarn of the present invention is operated as follows:

Installing two sets of fiber roving onto roving hangers 3; installing two sets of core filaments on filament drafting drums 4, and then start the machine. The two sets of fibrous roving are fed into the back roller 23 through two-eyes roving guide 5 for drafting, drafted fibrous roving then exits back roller 23 and feed into middle roller 22 and front roller 21 for further drafting and exit through nip of front roller 21. Adjusting the two filament guides 6 such that the first and second of core filaments are independently positioned on top of the first or second fiber roving: as the first fibrous roving exits from the nip of the front roller, the first fibrous will twist with the first core filament that is moving laterally at the same time, so as to form the first yarn. As the front roller rotates, the first yarn meets the second yarn soon and twist together, forming a multi-component elastic yarn.

The positions of the two eyes of the two-eyes roving guide are adjusted to ensure the two fibrous roving are fed in parallel during drafting and the distance between the centers of the two fibrous roving is kept within 3 mm to 12 mm. When the two sets of core filaments are low-elastic or inelastic filaments, the distance between the centers of the two fibrous roving guide can be adjusted and shifts to the larger range.

After the two fibrous roving have been drafted properly, the drafted fibrous roving exits from the nip of the front roller at the same time the positions of the two filament guides are adjusted such that the two filaments are independently positioned on top of the perspective fibrous roving. The distance between the two filament guides is adjusted between 3 mm to 15 mm. When the two filaments are low-elastic or inelastic filaments, the distance between the centers of the two filament guides shifts to the larger range.

The multi-component yarn of the present invention is constructed by twisting a single strand of fibrous roving and a single strand of core filament in a spinning triangle area to form a single yarn (the first yarn). The single yarn is further twisted with another yarn (the second yarn) constructed with another strand of fibrous silver and another strand of core filament. As the fiber roving is drafted to cylindrical yarns before twisting with the core filament, ends of the fibrous roving can be easily twisted into the yarns. Moreover, the core filaments which move forward laterally are twisted with the corresponding fibrous roving in a screw-like manner and the two core filaments can produce a certain grip effect when twisted with the two fibrous rovings independently, as a result, the fibers in the resultant composite yarn do not fall off easily and the fiber utilization is high, resulting in low hairiness and high strength in the composite yarn.

The multi-component elastic yarn of the present invention is suitable for all types of textile fabrics or can become a part of all types of textile fabrics; therefore, according to some embodiments of the invention, the new multi-component elastic yarn can be preferably woven into denim fabrics. The percentage of the present multi-component yarn in the textile fabric is not critical; generally the present multi-component yarn shall be at least 15% of the textile fabric, and preferably at least 20%.

WORKING EXAMPLES

Example 1

The warp is Ne10 pure cotton slub yarn (the roving is quantified as 0.9 g/m), the weft is Ne16 multi-component elastic yarn of the present invention, wherein the two fibrous rovings are made of pure cotton, and the roving is quantified as 0.6 g/m. The two core filaments are elastic filaments (quantity: 40 denier) and non-elastic filaments (quantity: 75 denier) respectively. The draft ratio of the elastic filaments and the non-elastic filaments is 3 and 1, respectively. A ⅓ denim fabric is produced, and the fabric weight is 11 ounces per square yard. According to ASTM D3107, the weft elongation of the denim fabric is 33%, and the weft elastic recovery rate of the fabric is 87%. The fabric has a smooth surface, low hairiness, high weft tensile and tear strength, and soft and smooth hand feeling.

Example 2

The warp is Ne7 pure cotton slub yarn (the roving is quantified as 0.9 g/m), the weft is Ne10 the multi-component elastic yarn of the present invention, wherein the two fibrous rovings are made of pure cotton, and the roving is quantified as 0.9 g/m. The two core filaments are elastic filaments (quantity: 40 denier) and non-elastic filaments (quantity: 75 denier) respectively. The draft ratio of the elastic filaments and the non-elastic filaments is 3 and 1, respectively. A ⅓ denim fabric is produced, and the fabric weight is 14 ounces per square yard. According to ASTM D3107, the weft elongation of the denim fabric is 20%, and the weft elastic recovery rate of the fabric is 92%. The fabric has a smooth surface, low hairiness, high weft tensile and tear strength, and soft and smooth hand feeling.

Example 3

The warp is Ne10 pure cotton slub yarn (the roving is quantified as 0.9 g/m), the weft is Ne10 the multi-component elastic yarn of the present invention, the two fiber roving are pure cotton, and the roving is quantified as 0.9 g/m. The two core filaments are elastic filaments (quantity: 70 denier) and non-elastic filaments (quantity: 75 denier) respectively. The draft ratio of the elastic filaments and the non-elastic filaments is 2 and 1, respectively. A ⅓ denim fabric is produced, and the fabric weight is 14 ounces per square yard. According to ASTM D3107, the weft elongation of the denim fabric is 23%, and the weft elastic recovery rate of the fabric is 88%. The fabric has a smooth surface, low hairiness, high weft tensile and tear strength, and soft and smooth hand feeling.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

The invention claimed is:

1. A method for manufacturing a multi-component yarn comprising providing a first fibrous roving and a second fibrous roving, and a first core filament and a second core filament;

providing a ring-spinning machine comprising a pair of back rollers and a pair of front rollers;

drawing the first fibrous roving and the second fibrous roving;

passing the first fibrous roving and the second fibrous roving through a two-eyes roving guide, wherein the distance between centers of the two eyes is 3-12 mm;

drafting the first and second fibrous roving by feeding the first and second roving into the pair of back rollers and passing drafted first and second fibrous roving through a nip of the pair of front rollers;

drafting the first and second core filaments by feeding the first core filament into a first filament drafting drum and feeding the second core filament into a second filament drafting drum, wherein the first core filament is an elastic filament and is drafted by the first filament drafting drum at a draft ratio of 1.5-4.5, and the second core filament is an inelastic filament and is drafted by the second filament drafting drum at a draft ratio of greater than 1.0 and less than 1.3;

twisting the first and second core filaments independently with the first and second fibrous roving to form a first yarn and a second yarn; and twisting the first and second yarn to form the multi-component yarn.

2. The method of claim 1, wherein weight percentage of said first and second core filament is 4%-50% of the component yarn.

3. The method of claim 1, wherein when the first and second core filaments range from 20-300 denier.

4. The method of claim 1, wherein the first and second fibrous roving are selected from the group consisting of natural fiber, synthetic fiber, artificially dyed fiber and a combination thereof.

5. An apparatus for manufacturing a multi-component yarn comprising a ring-spinning machine comprising two roving hangers located above a pair of back rollers for installing a first fibrous roving and a second fibrous roving;

a two-eyes roving guide located at the back of the pair of back rollers where the first and second fibrous roving pass through and wherein the distance between the centers of the two eyes is 3 mm 12 mm;

a first filament drafting drum and a second filament drafting drum located above the pair of back rollers, wherein the first filament drafting drum drafts a first core filament at a draft ratio of 1.5-4.5, and the second filament drafting drum drafts a second core filament at a draft ratio of greater than 1.0 and less than 1.3 wherein the first core filament is an elastic filament and the second core filament is an inelastic filament; and two filament guides located above a pair of front rollers for the first and second core filaments to pass through.

6. The apparatus according to claim 5, wherein the distance between the centers of the two filament guides is 3-15 mm.

* * * * *